United States Patent [19]

Triggs

[11] Patent Number: 4,802,446

[45] Date of Patent: Feb. 7, 1989

[54] SAFETY DEVICE FOR SUBCRITICAL PRESSURE STEAM BOILERS

[76] Inventor: Leonard E. Triggs, 407 Kindt Corner Rd., Shoemakersville, Pa. 19555

[21] Appl. No.: 43,185

[22] Filed: Apr. 27, 1987

[51] Int. Cl.[4] ..... F22B 37/42

[52] U.S. Cl. ..... 122/504; 122/451.1; 122/448 S; 236/14

[58] Field of Search ..... 122/504, 451.1, 451.2, 122/448 S; 236/14

[56] References Cited

U.S. PATENT DOCUMENTS 3,310,039 3/1967 Holt ..... 122/504

4,497,283 2/1985 La Spisa et al. ..... 122/451.1

4,541,365 9/1985 Jennings et al. ..... 122/451.1 X

*Primary Examiner*—Edward G. Favors

*Attorney, Agent, or Firm*—Leonard M. Quittner

[57] ABSTRACT

A safety device for subcritical natural and forced circulation boilers wherein the differential between downcomer fluid temperature and drum saturation temperature is measured and the trend of the differential is determined by computer means on a continuous basis. If the differential approaches a defined limit in its trend in a defined time interval or the furnace tube temperature increases instantaneously, the heat source for the boiler is diminished.

4 Claims, 2 Drawing Sheets

SAFETY DEVICE FOR SUBCRITICAL PRESSURE STEAM BOILERS

CROSS-REFERENCE

There are no cross-references to nor are there any related applications.

FEDERALLY-SPONSORED RIGHTS

The invention herein was made without any Federal sponsorship or contribution.

BACKGROUND OF THE INVENTION

1. Field of the Invention

This invention relates to an improved safety device to shut down a subcritical pressure natural circulation or forced circulation steam boiler under certain operating conditions.

2. Description of the Prior Art.

The prior art is best represented in U.S. Pat. Nos. 4,637,349 to Robinson (Jan. 20, 1982), 4,574,746 to Keyes, et. al., (Mar. 11, 1986) 4,598,669 to Funk, (July 8, 1986), 4,526,136 to Boland, et. al. (July 2, 1985), 4,452,849 to Pichot, et. al. (Sept. 24, 1986); 4,434,746 to Stewart (Mar. 6, 1984); 4,457,266 to LaSpisa (July 3, 1984); 4,373,663 to Hammer (Feb. 15, 1983) and 4,003,342 to Hodgson (Jan. 18, 1977); and in certain articles or monographs; Gardner, et. al., "Carry Under Performance in High Pressure Circulation Boilers" (1973; Proc. Inst. Mech. Eng.; London; p 207, et. seq.) and Williams: "Water Level Indication in Modern Power Plants, Nuclear and Fossil Fuel" (Combustion; Aug, 1969. New York; p 6, et. seq.) copies of which are attached hereto in the appendix in the assumption that they are not in the Office library.

The prior art teaches operators of subcritical pressure boilers to monitor at least two factors: steam drum pressure and steam drum water level. Steam drum water level is measured by sight glass means positioned outside the drum and/or by defined high and low drum water level sensing means. It is, of course, desirable that the drum maintain a relatively steady water level as steam is generated. A basic requirement for safe operation is for each pound of steam leaving the drum one pound of replacement or feedwater must be made available in addition to inventory water which maintains cooling medium for the pressure parts.

Drum pressure is measured by well-known sensing means, typically between 15 and 2,900 psi. Fluid satuaration drum temperture corresponding to drum pressure is typically 250°-690° F. Visual inspection of gauges, observed by the operator who modulates the flow of feedwater into the steam drum manually preserves the inventory water balance. It is also possible to replace the operator with automatic feedwater regulating controls.

The typical cycle in a natural circulation boiler after start up is for heat to be applied and inventory water to commence circulation by convection in the water tubes. As the water's density decreases with heat intake, the water rises in the risers as steam/water flows into the steam drum in which steam is separated from liquid by centrifugal separation or other means and is discharged from the drum to be super-heated for use. As steam is removed from the drum, feedwater which is at a temperature lower than that in the drum, i.e., subcooled, is inserted into the drum at a point or points substantially below drum water level and near where carry under steam, i.e., steam still entrained in the circulating fluid, will be condensed by the feedwater rapidly bringing the mixture up to near drum temperature. Circulating water, with no carry under steam left uncondensed, i.e., steam free, will be slightly subcooled and have a density greater than elsewhere in the drum and riser tubes and will gravitate into the downcomers to provide the natural circulation flow effect desired.

In the case of forced circulation boilers the density increase provides the suction flow for the boiler circulation pumps. Steam separation from liquid in the steam drum, subcooling and condensing of carry under steam by feedwater remain essentially the same as in natural circulation.

Automatic feed water regulating controls are well-known in the art, and consist of means by which discharge steam and feedwater flow are kept in balance by signal and valve modulating means, thereby reserving the operator's primary attention to drum water level only. Since this balance, too, can be regulated by sensing means a fully automatic control system is attainable.

An additional factor, blow down, is a means of maintaining chemical balance in the drum by reducing the soluble chemical levels. This is accomplished by removing inventory water from the drum through water discharge means and replacing it with feedwater which contains a lower level dissolved solids accordingly. Blow down may be regulated by sensors with small continuous removal of drum water controlled by separate valves. A removal/replacement rate of 1-5% of steam, discharge from the steam drum is typical. The drum water level will adjust to allow for blow down by itself. The key parameter to monitor remains drum water level.

Notwithstanding careful control at operating temperature and pressure of feedwater, outlet steam, drum water level and blow down, occasionally an unexplained catastrophic loss by steam explosion will occur in which drum water level appears to be at a nominal level. This has led to loss of life, severe injury and extreme damage to equipment which is perforce very expensive. In power generating installations the inevitable power loss ensuing can operate great harm on such population as is in need of the power. The prior art has tended to attributed the loss to a false indication of water level due to the phenomenon of swelling in which steam is dissolved in drum water to make it appear to occupy an apparently larger volume than it does or some other malfunction of the water level indication device. This is a dubious explanation.

Your inventor has found what appears to be a primary cause of heretofore unexplained catastrophic boiler failure and has invented a digital computer driven device to monitor for this cause and to warn an operator of its pendancy by alarm or to shut down the heat source to the boiler automatically.

SUMMARY OF THE INVENTION

Live carry under steam in the circulating saturated boiler water is steam in excess of boiler load. When mixed with the correct balance of sub-cooled feedwater, it yields "condensed phase" carry under steam. "Live steam" carry under can occur in the fluid entering the downcomers when feedwater flow falls below rate of steam flowing to the boiler load. Condensed phase fluid is of a greater density than drum water and it gravitates to the downcomer or is drawn down by the circulating pump. Any live steam carry under existing near downcomer entrance can be pulled into the downcomer by downthrusting or suction. The presence of any live steam in the downcomer will lower the driving head in the natural circulation process by reducing the density of the downcomer water. In the forced circulation process live steam will cause a reduction in mass flow-rate because pumps tend to operate as constant volume devices.

Under upset conditions wherein steam output is greater than feedwater input; adequate circulation will likely be lost before reduction of feedwater input is reflected in drum level measurement. It appears, due to the circulating characteristics of the boiler, that circulation loss, with attendant water tube overheating, can actually occur long before feed water reduction is sensed as a falling water level. Reliance, therefore, on drum water level is risky.

In the typical circulation cycle, carry under steam entrained in the drum water is used to raise subcooled feedwater to near saturation temperature. This accomplishes two critical design criteria. First, in a direct contact heating process subcooled feedwater will take up heat from carry under steam virtually instantaneously and, therefore, will maintain drum temperature and the balanced operation of the boiler. Second, live carry under steam will not be downthrusted into the downcomers or dragged in by suction where its presence reduces circulation and creates the potential for disaster by permitting overheating of tubes and a concomitant explosion of tremendous force. To prevent this, this present invention measures the temperature differential (dT) between that of the fluid in the downcomers (Tc) and the drum saturation temperature (Td) by analogue signals generated by thermocouple means. The anologue signals are sent to a multiplexer which assigns to the signal from each downcomer, or nest of downcomers, an address Ncn and temperature value Tdn which is paired with, typically, a defined proximal drum location having an address Ndn, and having a value of temperature Tdn at such location. These signals in the form Ndn, Tdn; Ncn, Tcn are read into the memory of a digital central processing unit and processed by algorithm means, which means matches the location Ndn with the location Ncn and calculates the differential, Tdn−Tcn=dTn, and accumulates and analyses this data. In smaller facilities the same drum temperature value, Tdo, will be paired a plurality downcomer values, Tcn, for calculation purposes.

Operating conditions dictate that downcomer fluid temperature could normally be typically as much as 25° F. less than saturation temperature, and of a higher density than that which prevails in riser tubes if the carry under steam is being completely condensed by the feedwater. Momentary or short term decreases in downcomer/saturation temperature differential are ignored since these are possible in normal transient operation. A downward trend of temperature differential, wherein dT approaches a defined limit less than dT, however, is crucial if it occurs over a time interval of typically a few minutes. Such a trend indicates severe downthrusting or suction of live carry under steam and resultant upset conditions. Under these circumstances the central processing unit will activate a shut down, run back or an alarm cycle as appropriate.

A redundant back-up means is provided in the present invention by measuring the water tube metal temperature on selective water tubes also by thermocouple means. Any sudden increase in water tube metal temperature will indicate imminent failure of the tube and the heat source is instantly deactivated.

An object of the present invention is to provide means for sensing downcomer/drum temperature differential trends.

A further object is to shut down a circulation boiler if a persistent excess of live carry under steam appears in the downcomers.

An additional object is to eliminate catastrophic loss in circulation boilers by preventing overheating of water tubes.

Other objects, advantages and features of the present invention will be apparent to those skilled in the art from the following description taken in conjunction with the accompanying drawings.

DESCRIPTION OF DRAWINGS

The present invention may be better understood by reference to the drawings wherein four (4) figures are shown on two (2) sheets. The number shown in the drawings for the various parts of the invention are consistent throughout so that a number indicating a part in one drawing will indicate the same part in another drawing.

DESCRIPTION OF THE PREFERRED EMBODIMENT

Figure 1:
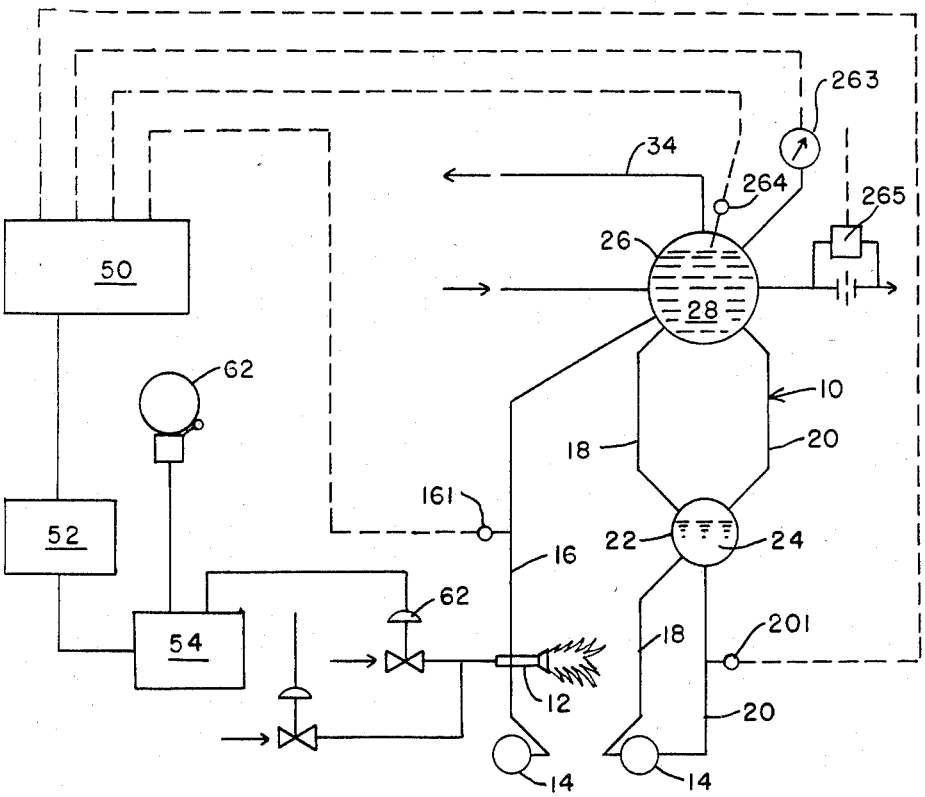
FIG. 1 shows a schematic diagram of a natural circulation boiler and the components of the invention.
Figure 2:
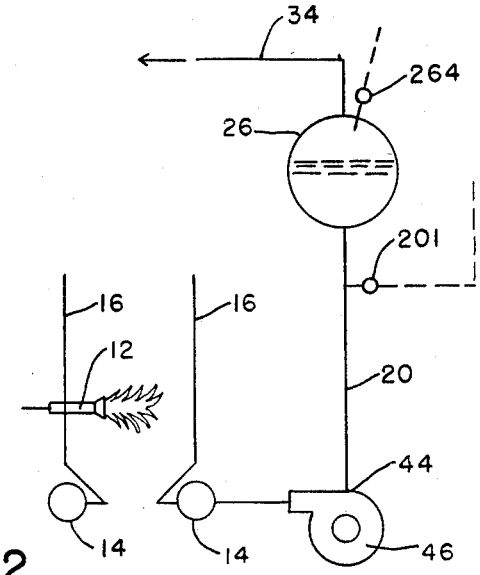
FIG. 2 shows a schematic diagram depicting the modification required by a forced circulation boiler.

A circulation steam boiler 10 comprises a heat source 12, a header 14, furnace tubes 16, risers 18, downcomers 20, a water drum 22 for circulating inventory water 24 and a steam drum 26. The steam drum receives saturated water/steam 28 from the risers into centrifugal means 30 and separation means 32 wherein live steam is separated and discharged 34 to a superheater (not shown). Inlet feedwater 36 is let into the steam drum from subcooled feed stock 38 where it mixes with carry under steam 40 to bring the feedwater to operating temperature. Inventory water is downthrust 42 or sucked 44 into the downcomers for recirculation by natural circulation or by pump means 46. Drum water is blown down 48 by removal from the system.

Figure 3:
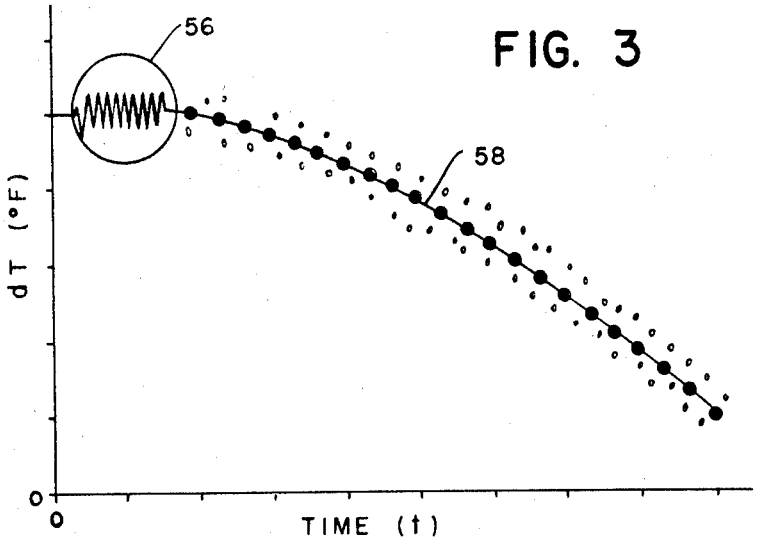
FIG. 3 shows a graph of drum/downcomer temperature differential against time and FIG. 4 is a detailed schematic diagram of a typical drum section of a natural circulation boiler.
Figure 4:
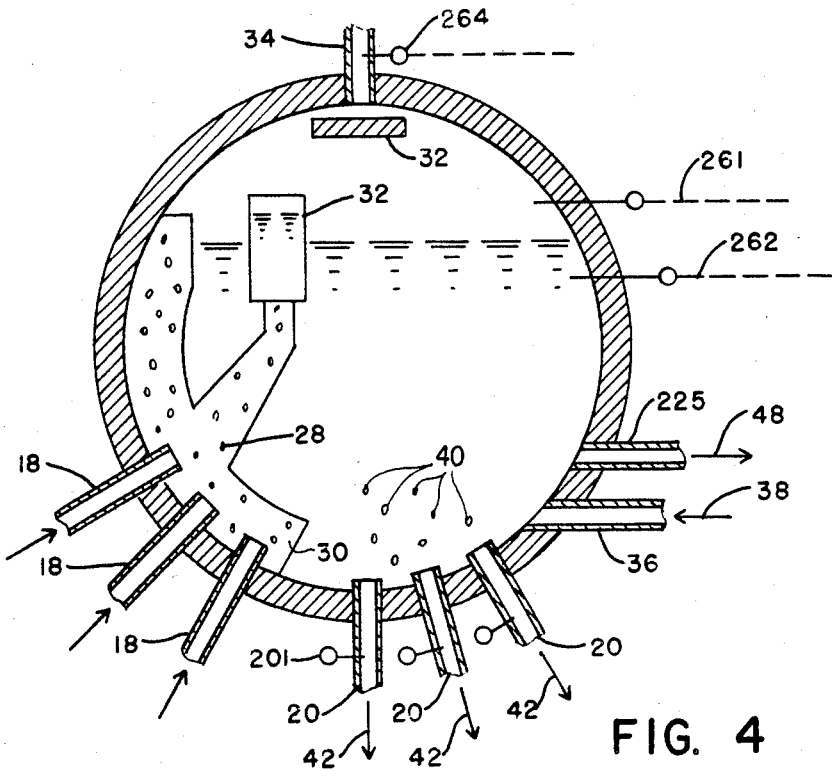

The steam drum is equipped with high 261 and low 262 water level sensing means, a pressure sensing means 263, for measuring discharge steam pressure, typically from 15 to 2900 psi, saturation drum water temperature sensing means 264, wherein drum water temperature is typically at 250°–690° F. Blow down flow indication means 265 is also provided. The downcomers are equipped with temperature sensing means 201 to measure downcomer fluid temperature. Furnace tubes are equipped with metal temperature sensing means 161. All means for sensing in the preferred embodiment are of the electrical transducer type and provide analogue signals. These are multiplexed in a multiplexer 50 which accumulates signal values sequentially and retransmits such values to a digitizer 52 for digitizing and storage in memory of a digital central processing unit 54. Within the central processing unit corresponding addresses (Ndn, Ncn) for drum and downcomer locations are matched and the calculation of temperature differential dTn=Tdn−Tcn is accomplished alogrithmically and retained in memory as a function of elapsed time (dt) in the form dTn, dtn. Each temperature differential/time datum is stored for a defined time interval in the form dTo, dto; dT1, dt1; . . . dTx, dtx as a data set and is progressively updated by dropping off a first instantaneous datum, e.g., dTo, dto, and maintaining a current data set dT1, dt1, dT2, dt2 . . . dTx+1, dtx+1. Algorithmic comparison means available in memory measures a dT trend less than a defined temperature differential over the defined time interval. See FIG. 3 where a steady situation 56 shows small instantaneous changes in temperature. When a downtrend persists 58, a signal 60 is generated in the central processing unit to diminish or shut down 62 the heat source or to sound an alarm. Boiler size, tube configuration, downcomer and riser disposition will cause variations in trend time. Idiosyncratically, use of c.p.u. memory in a normally functioning boiler will create a defined data set showing no trend. The normal range of instantaneous differential values will also be found Based upon experience, equipment value and the use for which the steam is generated, the nominal trendless data set will be established and defined. Trend downward toward a defined limit over a defined elapsed time then will indicate the approach of upset conditions and will cause an alarm to sound, heat source to shut down, or, in the case of complex electrical generation schemes, the activation of a run back cycle stored in another computer.

A fail safe back-up which measures any instantaneous upsurge in furnace tube casing temperature above a defined safe level is provided 161 to ensure against imminent tube failure.

Other differential measurement mechanisms such as pneumatic or hydraulic means known in the art which can be coordinated with a clock function are adaptable to the present invention. Such mechanisms, however, are susceptible to a relatively high rate of failure or require continuous maintenance. Programmatic means of the type described resident in a central processing unit are easier to operate and to control with the advantage of ease of time measurement, important in the safety device described, and contribute substantially to the preference of this embodiment.

Since many modifications, variations and changes in detail may be made to the presently described embodiments, it is intended that all matter in the foregoing description and accompanying drawings be interpreted as illustrative and not by way of limitation.

What is claimed:

1. An improved subcritical pressure boiler with a heat source, a steam drum, inventory water, a plurality of risers, downcomers, headers and furnace tubes in combination comprising:

a. means for sensing saturation drum water temperature and generating a first signal therefor;
b. means for sensing temperature in the downcomer and to generate a second signal therefor;
c. means for finding the subtractive difference between the first signal and second signal;
d. means for measuring a trend of the subtractive difference in a defined time interval;
e. means for diminishing the heat source if the subtractive difference approaches a defined limit in the defined time interval.

2. In a boiler as in claim 1 wherein there are means for sensing temperature in the furnace tube's casing and generating a signal therefor and means for diminishing the heat source if the casing temperature signal instantaneously exceeds a defined value.

3. An improved subcritical pressure boiler with a heat source, a steam drum, inventory water, a plurality of risers, downcomers and furnace tubes in combination comprising:

a. means for sensing saturation drum water temperature in a plurality of defined locations and generating a plurality of first analogue signals therefrom;
b. means for sensing temperature in a plurality of downcomers in a plurality of defined locations proximal to the drum temperature locations and generating a plurality of second analogue signals therefrom;
c. means for multiplexing the first and second analogue signals in pairs by defined location;
d. means for converting the first and second analog signals to digital signals in a data stream of signals;
e. means for storing the data stream in a digital computer having a central processing unit;
f. means for the central processing unit to match first and second digital signal pairs which pairs are equivalent to the proximal drum and downcomer locations;
g. means for finding the subtractive differential value between each first and second signal pair;
h. means for timing successive differential values over a defined time interval;
i. means for determining when any differential value approaches a defined limit for the defined time interval;
j. means for generating a third signal when the differential approaches the defined limit for the defined time interval;
k. means to diminish the heat source upon the generation of the third signal.

4. In a boiler as in claim 3 wherein there are means for sensing temperature in the furnace tube's casing and generating a signal therefor and means for diminshing the heat source if the third signal exceeds a defined value.

* * * * *